US005913307A

United States Patent [19]

Taieb et al.

[11] Patent Number: 5,913,307

[45] Date of Patent: Jun. 22, 1999

[54] BREATHING PROTECTION EQUIPMENT WITH OPERATING MODE INDICATION

[75] Inventors: Denis Taieb, Creteil; Thierry Touratier, Montmorency; Michel Bardel, Maurepas, all of France

[73] Assignee: Intertechnique, Plaisir, France

[21] Appl. No.: 08/907,967

[22] Filed: Aug. 11, 1997

[30] Foreign Application Priority Data

Aug. 16, 1996 [FR] France ..... 96 10256

[51] Int. Cl.[6] ..... A62B 7/00; A62B 9/04; A62B 27/00; A62B 18/02

[52] U.S. Cl. ..... 128/205.23; 128/202.22; 128/202.27; 128/204.26; 128/205.24; 128/205.25

[58] Field of Search ..... 128/202.22, 202.27, 128/205.23, 205.25, 206.21, 205.11, 205.24, 204.26, 200.24

[56] References Cited

U.S. PATENT DOCUMENTS

| | | | |
|---|---|---|---|
| 2,378,468 | 6/1945 | Denubg | 128/205.11 |
| 2,403,508 | 7/1946 | Deming | 128/205.11 |
| 2,473,922 | 6/1949 | Tobias | 128/205.23 |
| 2,892,456 | 6/1959 | Seeler | 128/202.22 |
| 3,092,104 | 6/1963 | Cassidy | 128/202.22 |
| 3,386,458 | 6/1968 | Wasserman et al. | 128/205.11 |
| 3,508,542 | 4/1970 | Browner | 128/202.22 |
| 3,875,957 | 4/1975 | Veit et al. | 128/205.11 |
| 4,423,723 | 1/1984 | Winkler et al. | 128/202.22 |
| 4,440,166 | 4/1984 | Winkler et al. | 128/202.22 |
| 4,651,728 | 3/1987 | Gupta et al. | 128/201.28 |
| 4,827,964 | 5/1989 | Guido et al. | 128/204.21 |
| 4,870,960 | 10/1989 | Hradek | 128/202.22 |
| 5,022,393 | 6/1991 | McGrady et al. | 128/205.23 |
| 5,097,826 | 3/1992 | Gray et al. | 128/202.22 |
| 5,111,809 | 5/1992 | Gamble et al. | 128/205.11 |
| 5,460,175 | 10/1995 | Foote et al. | 128/205.11 |
| 5,540,218 | 7/1996 | Jones et al. | 128/205.11 |
| 5,601,078 | 2/1997 | Schaller et al. | 128/202.22 |

FOREIGN PATENT DOCUMENTS

| | | | |
|---|---|---|---|
| 47575 | 3/1982 | European Pat. Off. | 128/202.22 |
| 0252281 | 6/1987 | European Pat. Off. . | |
| 4201832 | 7/1993 | Germany | 128/205.23 |
| 4425262 | 8/1995 | Germany . | |
| 4418020 | 11/1995 | Germany . | |
| 2058580 | 4/1981 | United Kingdom | 128/202.22 |
| 2273054 | 6/1994 | United Kingdom . | |
| 2277451 | 11/1994 | United Kingdom | 128/205.23 |
| 2294349 | 4/1996 | United Kingdom . | |

OTHER PUBLICATIONS

*Cassell's Compact French Dictionary*, G. H. Douglas et al, Dell Pub. Co., ©Cassell and Co. LTD, ISBN 0–440–31128–4. Sep. 1981. pp. 278,279,538,539.

*Primary Examiner*—Kimberly L. Asher
*Attorney, Agent, or Firm*—Larson & Taylor

[57] ABSTRACT

The breathing protection equipment includes a mask having an inflatable harness and a demand regulator with three operating modes which are manually selectable. The operating mode is indicated to the wearer of the mask by a repeater. The repeater has a mode sensor carried by the mask and a mode indicator located in the field of view of the wearer and driven by the mode sensor. The mode sensor may detect the position of the switch actuated by the user for changing the mode. The mode indicator may be a display on a mask storage box or on the mask.

6 Claims, 3 Drawing Sheets

10
12
24
14
22
20
13
11
16
18

12
24
20
10
22
11

BREATHING PROTECTION EQUIPMENT WITH OPERATING MODE INDICATION

BACKGROUND OF THE INVENTION

The invention relates to breathing protection equipment including a breathing mask provided with a regulator having a plurality of operating modes, selectable by means that are not in the field of view of the user while using the mask.

A major, but non-exclusive, use of such a mask lies in aviation equipment; it is conventional to have three operating modes: "normal" mode supplying the user with a mixture of ambient air and oxygen; "100%" mode supplying pure oxygen; and "emergency" mode supplying pure oxygen under pressure.

As a general rule, the operating mode is selected by actuation of one or more mechanical switches placed on the regulator body of the mask at a location that is outside the field of view of the user. In other cases, the operating mode is selected automatically in response to information supplied by a sensor integrated in the regulator and serving, for example, to detect depressurization of the cabin.

In both cases, the user cannot visually check the operating mode of a mask while it is being worn: the user must feel the position of the switch or remove the mask to look at its position. In practice, such verification is generally not performed. Consequently there is a risk of leaving the regulator in a mode that is not appropriate, e.g. "100%" or "emergency" mode when that is unnecessary (thereby using up the oxygen supply pointlessly) or in the "normal" mode when there is smoke in the cabin (a situation that could lead to the user being physically harmed).

SUMMARY OF THE INVENTION

An object of the invention is to enable the user to verify the operating mode of protection equipment quickly and easily. To this end, there is provided equipment having mode indicator system comprising a mode sensor secured to the mask and connected by transmission means to mode indicator means giving information that is directly perceivable by the user.

When selection is performed manually, the sensor will generally be designed to sense the position of a switch or switches actuated by the user. Nevertheless, the sensor may respond to some other parameter characteristic of an operating mode or of a changeover from one mode to another. For example, it may sense the position or the displacement of internal elements of the regulator, the rate at which breathing gas is being fed, the feed pressure, or the composition of the gas mixture supplied to the mask.

The mode indicator system may be put into operation responsive to detection that the mask has gone from a storage position to an in-use position. Such detection can be performed by various means, and a choice can be made between them at the equipment design stage, depending on the kind of mask and on how it is stored. For example, it is possible to detect that the doors of a storage box have been opened, or that a pneumatic harness for fast donning of the mask has inflated, or that an oxygen feed valve has opened.

A very wide variety of transmission means can be used, operating electrically, pneumatically, by means of guided light, or even by a non-guided radio or infrared link (even though such complication is generally not advantageous).

When the sensor is designed to be placed in a space that might be receiving pure oxygen, it can be preferable to avoid using a sensor having an electrical contact that is alternately made and broken.

It is also possible to have a very wide variety of mode indicator means. They may be constituted by display lights, indicator lamps, by a display of plain text, by movable mechanical indicators, by a sound message or signal generator making use of cabin loudspeakers or user headphones, or even by a projector onto a mask visor; the mode indicator means may also make use of an on-board computer which then generates the data for presenting information. A voice message transmitted over the cabin loudspeakers on each change in operating mode has the advantage of being recorded by the flight recorder or "black box".

When mode indication is visual, it can be performed on the mask itself at a location that is visible in normal operation, or preferably on the mask storage box, or on the instrument cluster panel. The first two solutions have the advantage of providing equipment that is integrated in structure.

Other characteristics will appear more clearly on reading the following description of particular embodiments, given as non-limiting examples. The description refers to the accompanying drawings.

DETAILED DESCRIPTION

Figures 1, 2:
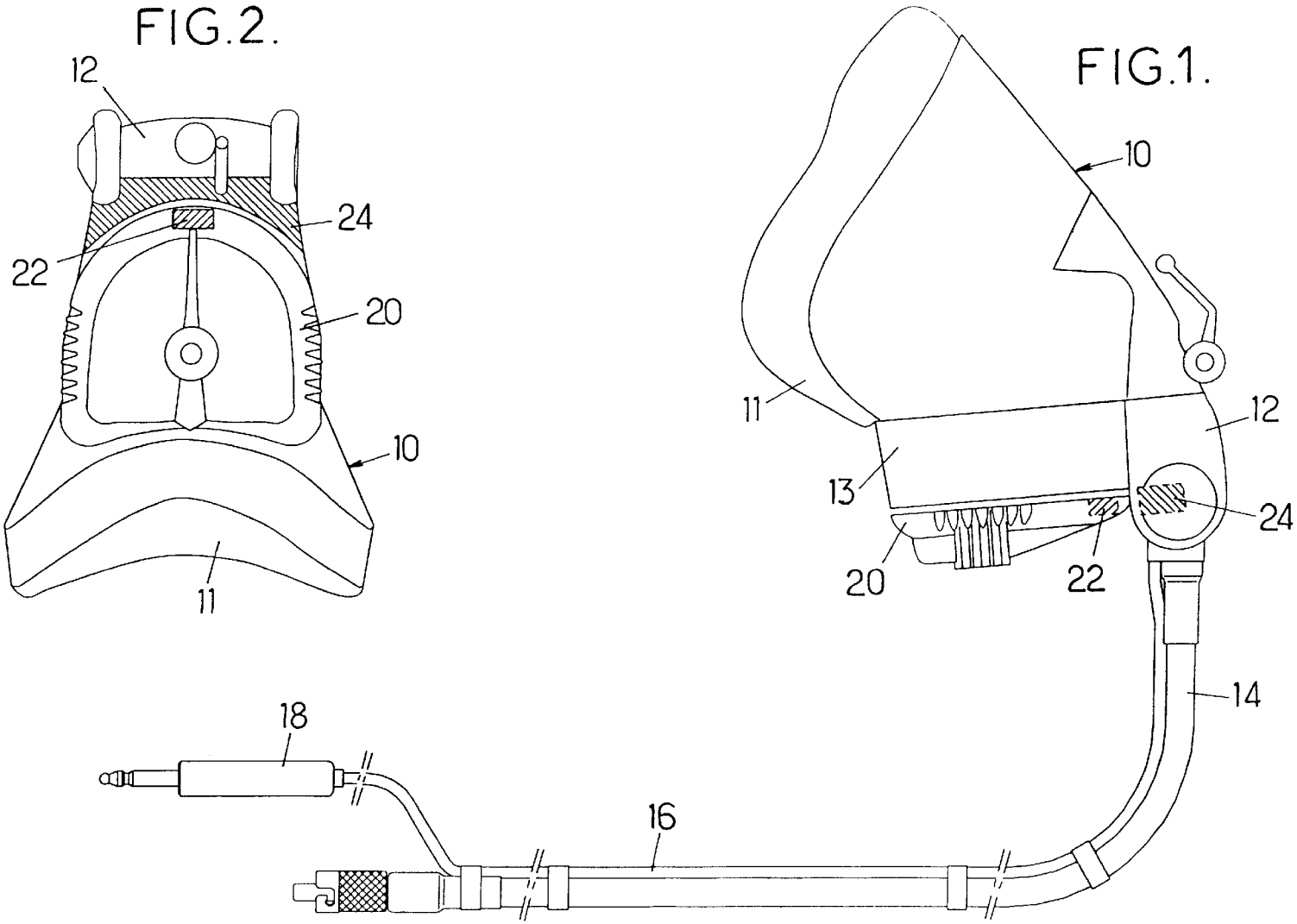
FIG. 1 is a side view of a breathing mask having a mode switch controlled by a rotary knob placed beneath the mask and therefore not visible to the user.
FIG. 2 is a view of the underside of FIG. 1 with the oxygen feed hose and the outlet cable omitted.

The breathing mask shown in FIG. 1 is of a general structure that is in widespread use at present in protection equipment for flight crew. The mask 10 is provided with a harness (not shown) which may be inflatable in order to enable it to donned quickly. It comprises a mouth and nose face piece 11 fixed to a demand regulator 13 and to a rigid connection block 12. The connection block 12 has a coupling to a flexible duct 14 for connection to a source of oxygen under pressure.

A cable 16 terminated by a connector 18 contains, in particular, wires connecting with a microphone placed in the mask.

The demand regulator 13 is typically designed to operate in three different modes:

- "normal" mode referred to below as "N mode", in which it supplies the user with a mixture of ambient air and oxygen;
- "100%" mode in which it supplies pure oxygen; and
- "emergency" mode referred to below as "EM mode" in which the user is supplied with pure oxygen under pressure.

In FIGS. 1 and 2, mode selection is performed by means of a rotary knob 20 capable of being put in as many positions as there are modes.

In accordance with a first embodiment of the invention, a mode sensor consists of a position sensor for sensing the position of the rotary member. The sensor may, for example, comprise a permanent magnet 22 fixed to the knob, as represented by a shaded rectangle in FIGS. 1 and 2, and a detector block 24 secured to the connection block or to the regulator housing. The connection block is connected to the outside via one or more wires, depending on its design. These wires may be incorporated in the cable 16.

Figure 3:
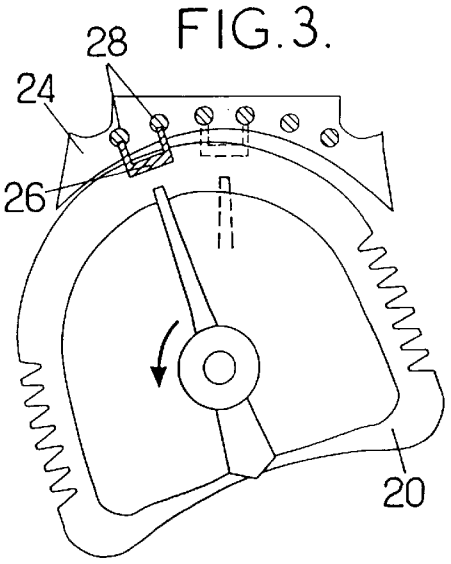
FIG. 3 is a diagram similar to FIG. 2 showing a position sensor for a control knob.

In the particular embodiment shown diagrammatically in FIG. 3, the sensor comprises a brush 26 fixed on the knob 20 and apt to connect together pairs of contacts belonging to the detector block 24. In a first position, e.g. corresponding to N mode, the conductive brush 26 has the position shown in continuous lines. It interconnects the contacts 28 of a first set of contacts. In a second position, shown in dashed lines in FIG. 3, and corresponding for example to 100% mode, the brush interconnects two other contacts. Finally, in its position when fully rotated clockwise (as shown in the drawing) the brush interconnects the contacts of a last set. Resilient locking means are generally provided to ensure that the position of the knob 20 is stable only when it is in any one of the three above positions, corresponding to the N, 100%, and EM modes.

Figure 4B:
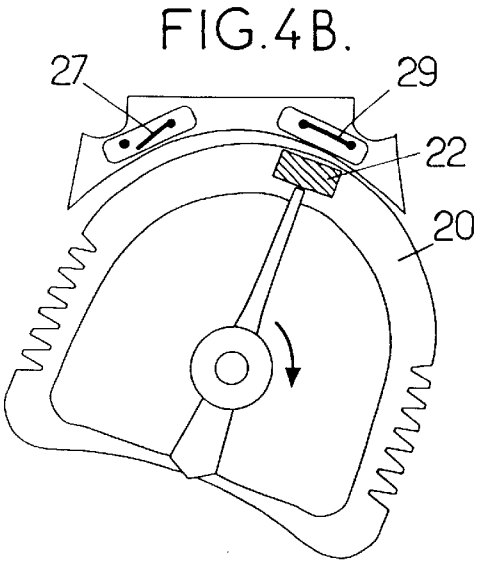
FIGS. 4A and 4B are similar to FIG. 3 and show another sensor, using a permanent magnet fixed on the rotary control knob and actuating reed switches placed on the body of the regulator.
Figure 4A:
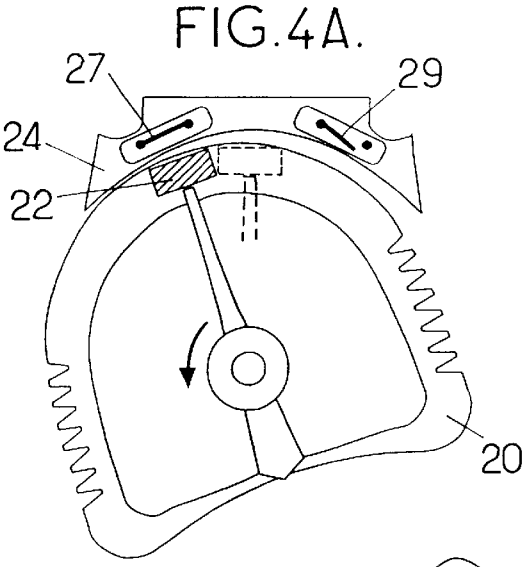

In the modified embodiment shown in FIGS. 4A and 4B, the mode sensor again is a position sensor which comprises a permanent magnet 22. The detection block 24 contains two reed switches 27 and 29. When the knob 20 is in the position shown in FIG. 4A, e.g. corresponding to N mode, switch 27 is closed by the element 22 located close thereto, while switch 29 is open. In the position shown by dashed lines in the same figure (e.g. corresponding to 100% mode), both switches are open. Finally, in the extreme position shown in FIG. 4B (EM mode), the switch 27 is open while the switch 29 is closed.

Figure 5:
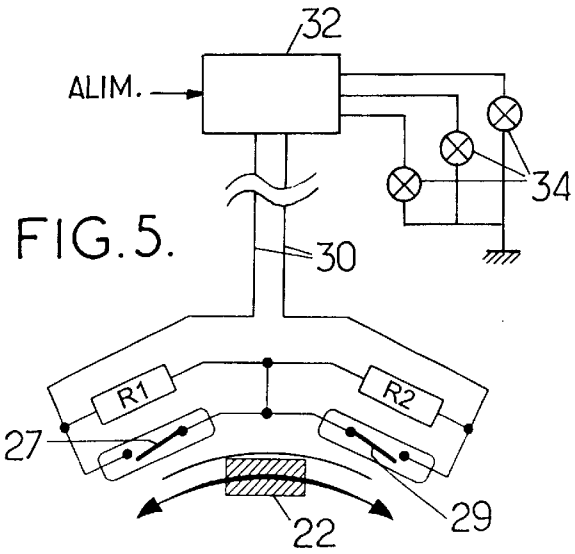
FIG. 5 shows a possible electric circuit for the switches of the sensor.

The switches 27 and 29 (as the contacts 28 in the previous case) can be connected in various kinds of circuit. FIG. 5 shows a circuit making it possible to limit the number of outlet wires to two. Resistors $R_1$ and $R_2$ having different resistance values are connected respectively in parallel with the switches 27 and 29, and these switches are connected in series in a circuit having two output wires 30 connected to a module 32 which, for example, powers indicator lights 34. The module applies a voltage across the wires and the current flowing along the circuit is measured by mode indicator control means (not shown). The current or voltage obtained from a converter is compared with two thresholds. This solution has the advantage of simplicity, since the transmission means are restricted to two wires 30, and the mode indicator means comprise, in addition to a visual display and optionally an audible repeater, simple electrical means only.

Figure 6:
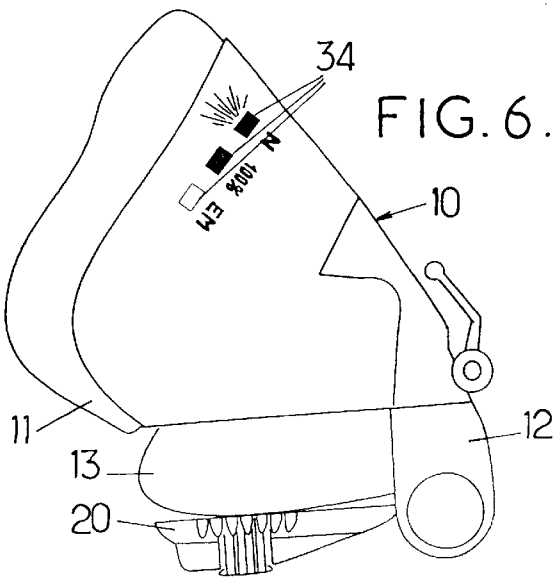
FIG. 6 shows mode indicator means constituted by indicator lights placed on the body of the mask.
Figure 7:
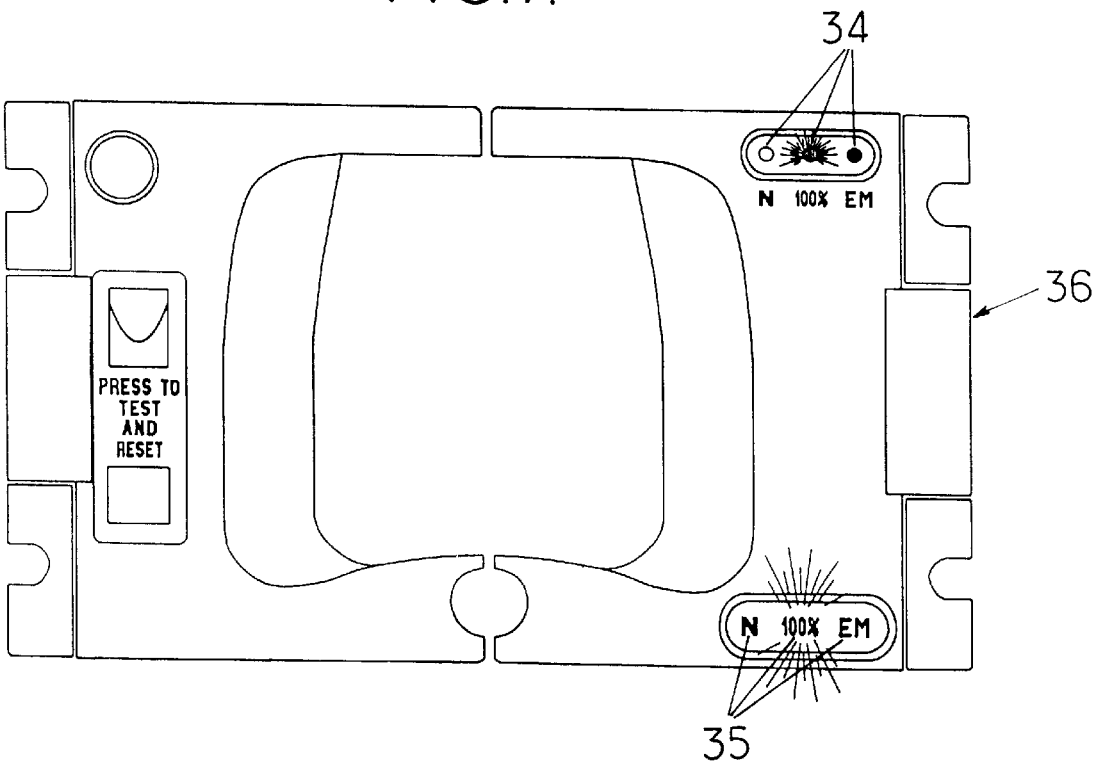
FIG. 7 shows mode indicator means constituted by luminous displays on the front face of a mask storage box.

In the example shown in FIG. 6, where elements already shown in FIG. 1 are given the same reference numerals, the mode indicator means are constituted by signal lights placed on the shell of the mask 10, at a location where they are visible for the user but without reducing field of view. To make discrimination more reliable, the lights 34 each corresponding to a different mode may be of different colors. The module 32 energizes only one signal light 34 at a time. It may also be connected to the on-board computer, when such a computer is provided. The computer can be programmed to generate a message by voice synthesis when the equipment is put into operation and/or each there is a change of mode. Then the mode indicator means include the computer and loudspeakers or user's earphone, as already indicated In the embodiment of FIG. 7, the signal lights 34 (or the display in plain language 35) are placed on the front face of the mask storage box 36, which may otherwise be conventional in structure and also stores the flexible duct and cable when the mask is not in use. This solution is preferred, since it makes it possible to provide equipment that is fully integrated and may be directly used.

Figure 8:
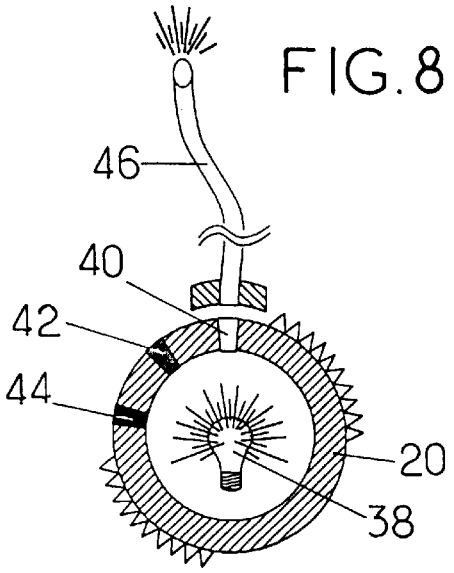
FIG. 8, also similar to FIG. 3, shows an optical mode sensor.

In FIG. 8 the mode indicator means includes a light source 38 placed inside the knob and an annular portion of the knob which carries three transparent windows 40, 42, and 44 of different colors. In the position shown in FIG. 8, the window 40 is interposed between the source 38 and one end of an optical fiber 46 which constitutes information transmission means. The other end of the optical fiber may be placed in a location where it is visible to the user, thereby constituting mode indicator means. The end changes color when the window 42 or 44 is brought to face the optical fiber. By way of example, the light source may be switched on by opening the doors of the storage box.

In all of the embodiments described above, the position of a switch constitutes the detected parameter. Other input parameters could be used. A mode sensor may be a flow rate sensor placed on the feed hose 14 to detect, for example, switching to EM mode, since that gives rise to a considerable increase in flow rate. A sensor for sensing the composition of the breathing gas may be provided to distinguish N mode from 100% and EM modes. Other parameters can also be used.

We claim:

1. Breathing protection equipment comprising:

a breathing mask provided with a demand regulator having a plurality of operating modes, means carried by the mask and manually actuatable by a wearer of the mask for selection of one of said operating modes, said manually actuatable means being located outside of a field of view of a wearer of the mask; and a mode indicator system comprising a mode sensor carried by the mask for detecting the selected operating mode, mode indicator means giving information directly perceivable by the wearer of the mask and transmission means connecting said mode sensor and said mode indicator means responsive to signals provided by said mode sensor.

2. Equipment according to claim 1, wherein said manually actuatable means comprises a switch and said mode sensor is constructed and arranged to be responsive to positions of the switch.

3. Equipment according to claim 1, further comprising a storage box for said mask, wherein said mode indicator system is arranged to be rendered operative responsive to removal of the mask from the storage box.

4. Equipment according to claim 1, wherein said mode indicator means comprises at least one of display lights, indicator lamps, display of plain text, and sound messages.

5. Equipment according to claim 1, wherein said mode sensor is constructed to be responsive to changes between said operating modes.

6. Breathing protection equipment having a plurality of operating modes, comprising:

a breathing mask provided with a demand regulator having a plurality of operating modes, means carried by the mask and manually actuable by a wearer of the mask for selection of one of said operating modes, said manually actuable means being located outside of a field of view of a wearer of the mask;

a storage box for said mask, located in said field of view of the wearer of the mask and connected to said mask by an oxygen supply hose and an electrical cable; and a mode indicator system comprising a mode sensor carried by said mask, and mode indicator means located on a front face of said storage box for giving a visual indication of the current operating mode when operative, and transmission means including said cable, connecting said mode sensor and said mode indicator means for driving said mode indicator means responsive to signals provided by said mode sensor, said mode indicator system being rendered operative responsive to opening of the storage box and removal of the mask.

* * * * *